United States Patent [19]

Jones

[11] 4,014,172

[45] Mar. 29, 1977

[54] DIFFERENTIAL AIR PRESSURE DRIVEN ENGINE

[76] Inventor: Thomas Jones, 5633 S. Loomis, Chicago, Ill. 60636

[22] Filed: Nov. 3, 1975

[21] Appl. No.: 628,519

[52] U.S. Cl. ..... 60/650; 60/721
[51] Int. Cl.[2] ..... F01K 25/00; F02G 1/00
[58] Field of Search ..... 60/650, 682, 407, 409, 60/410, 412, 370

[56] References Cited

UNITED STATES PATENTS

| | | | |
|---|---|---|---|
| 590,228 | 9/1897 | Knight | 60/682 |
| 774,778 | 11/1904 | Pratt | 60/682 |
| 3,563,032 | 2/1971 | LaPointe | 60/412 |

*Primary Examiner*—Allen M. Ostrager
*Attorney, Agent, or Firm*—McWilliams & Mann

[57] ABSTRACT

An air driven engine of the reciprocating piston type wherein the pistons are each disposed in their own cylinder and connected in cranking relation to the crank shaft that is the powered component of the engine, in which the piston power strokes are effected using heated air under pressure, and their return strokes are accentuated by exposing the working surfaces of the pistons to a cooled source of vacuum. Timer mechanisms are provided for controlling the sequencing of the differential force applications to the pistons. The sources of air pressure and vacuum are tanks associated with the engine. The apparatus includes an air pump operated as required through a crank shaft to restore the pressure and vacuum tanks to the desired pressure levels, this being done by recycling the air through the system with adequate make up as required to replace energy losses due to friction and leakage.

13 Claims, 36 Drawing Figures

119
120
100
89
105
504
145
146
148
144
127
304
28
306
236
71
69
126
127
130
131
121
146
129
111A
143
72
122
41
122
391
142
79
133
135
78
134
114
266
5
109
136
139
110
138
120
140
137
141
214
47
48
11
11A

FIG. 6
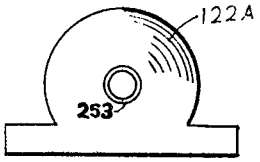
FIG. 5
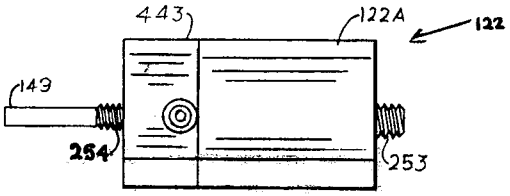
FIG. 7
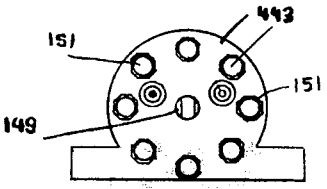
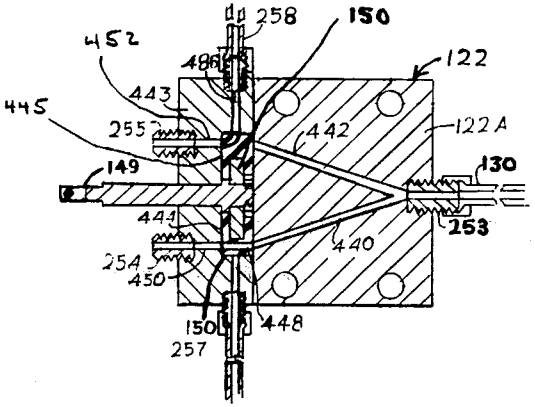
FIG. 8

156
162
163
11
157
374
372
370
376
168A
167
160
169
161
164
158
163
157A
159
166
165
162
168
170
170B
90°
0°
320
362
38
45°
364
37
60°
348
32
110°
20°
360°
350
200°
290°
31

DIFFERENTIAL AIR PRESSURE DRIVEN ENGINE

This invention relates to an air driven engine apparatus, and more particularly to an air driven engine apparatus utilizing air pressure and vacuum as well as heating of the pressure air and cooling of the source of vacuum to maximize kinetic energy output.

The concurrent energy and environmental crises currently being experienced have made important development of prime movers that provide the needed kinetic energy output with motivating means that is readily and widely available and free from pollution problems.

This invention is concerned with the use of ordinary air as the prime mover motivating agency and without requiring the burning or firing of fuels within the engine to drive same.

A principal object of the present invention is to provide an engine apparatus driven using as the driving agency, rather than fuel, as such, that is consumed, a medium that may not only be used and re-used repeatedly, but also largely indefinitely.

Another important object of the invention is to provide an engine apparatus of the reciprocating piston rotating crank shaft type, and methods of operating same, in which the pistons are powered by heated air under pressure and vacuum under refrigerated conditions to maximize the torque output achieved utilizing air at differential pressures.

Other objects of the invention are to provide an air operated engine apparatus that is of wide application in industry and commerce, that makes no pollution discharges to the atmosphere, and that is economical of manufacture, convenient to install and use, and long lived and economical in operation.

In accordance with the invention, an air driven engine is provided comprising an engine block having a plurality of cylinders each equipped with a piston reciprocable therein and connected in cranking relation to a crank shaft journalled in the engine, a source of heated air under pressure in the form of a tank adjacent the engine, a source of vacuum under refrigerated conditions in the form of a tank adjacent the engine, a cylinder air flow input timer, an air pressure conduiting means connecting the source of air under pressure to the input timer including a flow control valve for controlling the volume rate of air flow to the input timer, a cylinder air flow output timer, and an air vacuum conduiting arrangement connecting the output timer to the source of vacuum including a vacuum timer which connects the output timer to the source of vacuum only when the output timer valving is open.

The input and output timers are provided with porting individual to the respective cylinders and operatively connected therto for connecting the individual cylinders to the sources of air pressure and vacuum, with the timers being oriented to, for each cylinder, sequentially connect such cylinder only to the source of air under pressure on the power stroke of the piston thereof, and sequentially connecting such cylinder only to the source of vacuum on the return stroke of the piston thereof, for utilizing the differential pressures provided by the sources of compressed air and vacuum to rotate the crank shaft.

The engine assembly includes an air pump periodically operated by the engine as required to maintain the sources of air pressure and vacuum at desired levels, by drawing the air from the vacuum tank and pumping it to the air pressure tank, supplemented as needed by outside air to make up for losses due to friction and leakage.

A spare pressure tank is connected to the air pump in parallel with the main pressure tank, with the spare tank being connected to the main pressure tank by a pressure sensitive control valve which communicates the spare tank to the main pressure tank when the pressure in the main pressure tank reaches a predetermined minimum. The spare tank may also be used to start the engine when the engine has been shut down for an extended period of time.

The engine requires no fuel as such and yet provides the same speed and power as a gasoline fueled internal combustion engine of comparable displacement.

Other objects, uses and advantages will be obvious or become apparent from a consideration of the following detailed description and the drawings in which like reference numerals indicate like parts throughout the several views.

Figure 1:
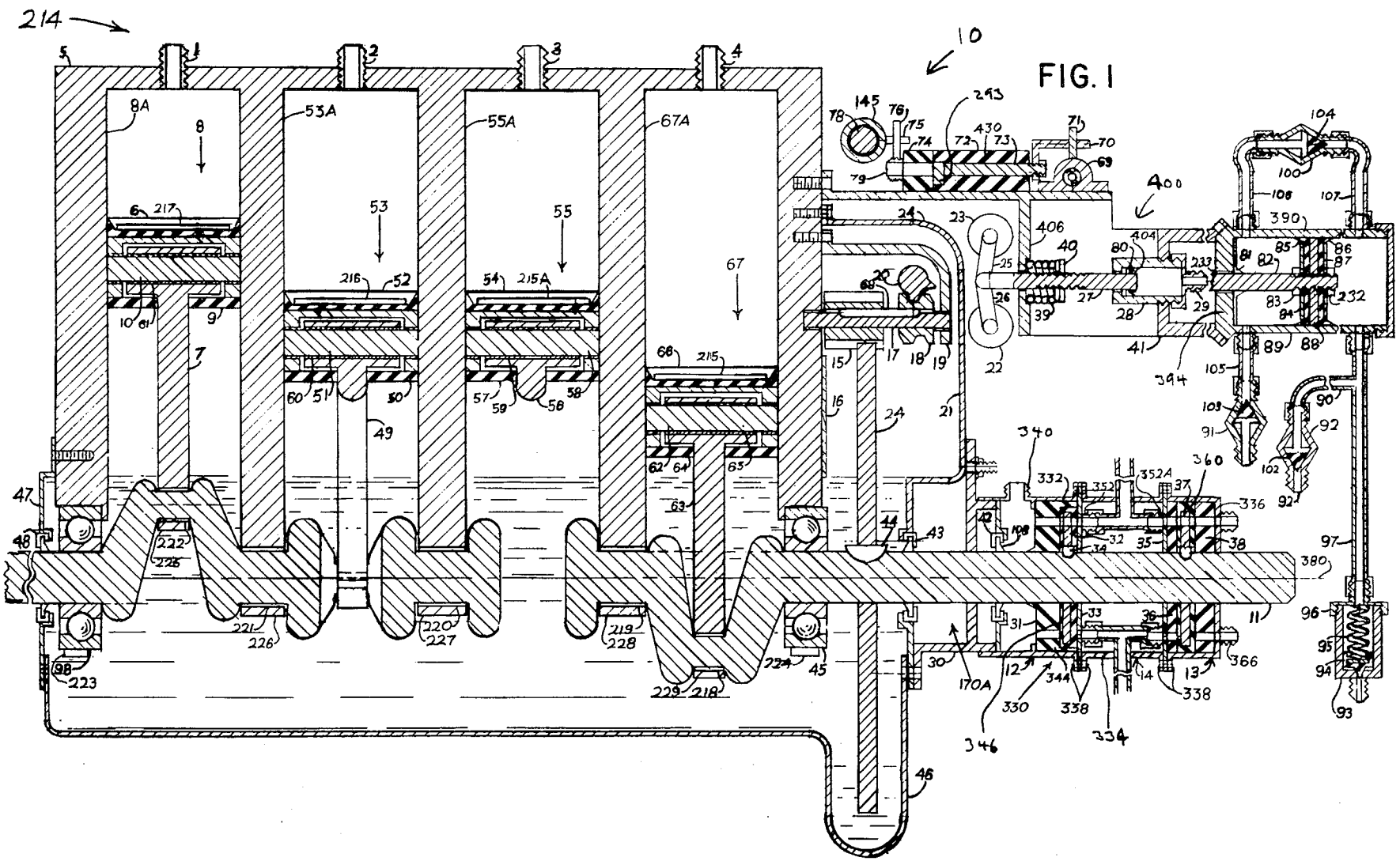
FIG. 1 is a longitudinal vertical sectional view through the air engine itself, with some parts being shown diagrammatically to facilitate illustration.
Figure 4:
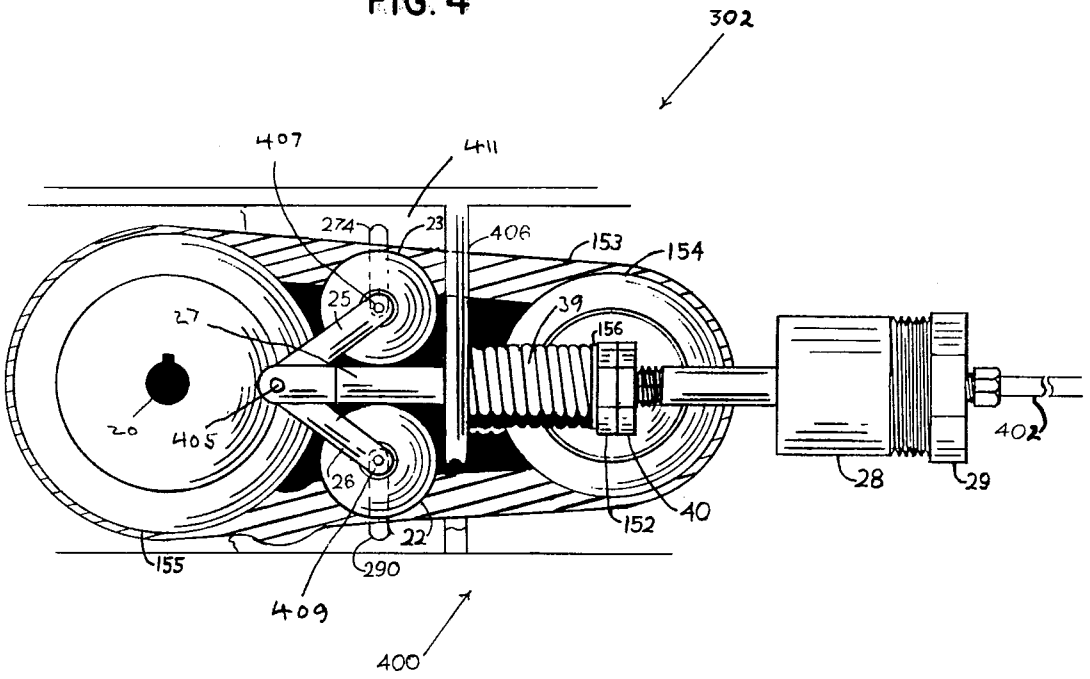
Figure 9:
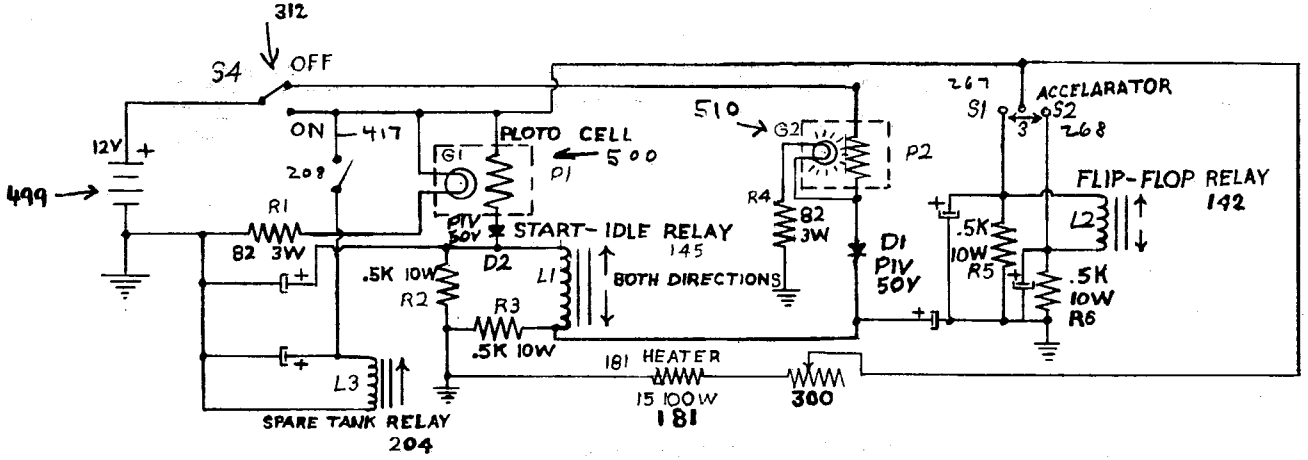
Figure 12:
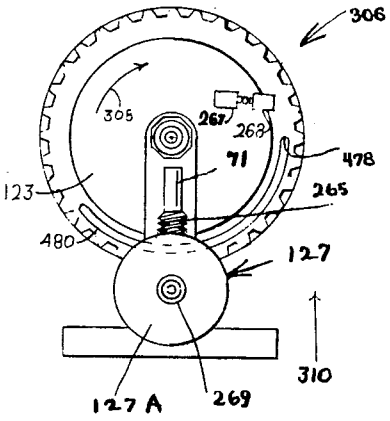
Figure 10:
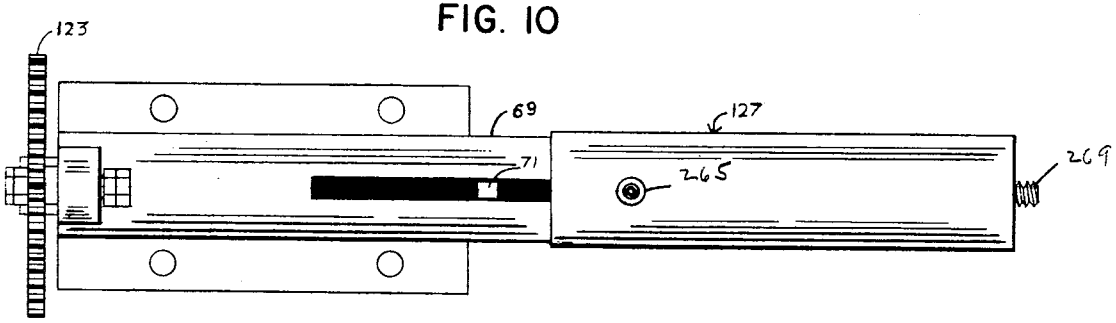
Figure 11:
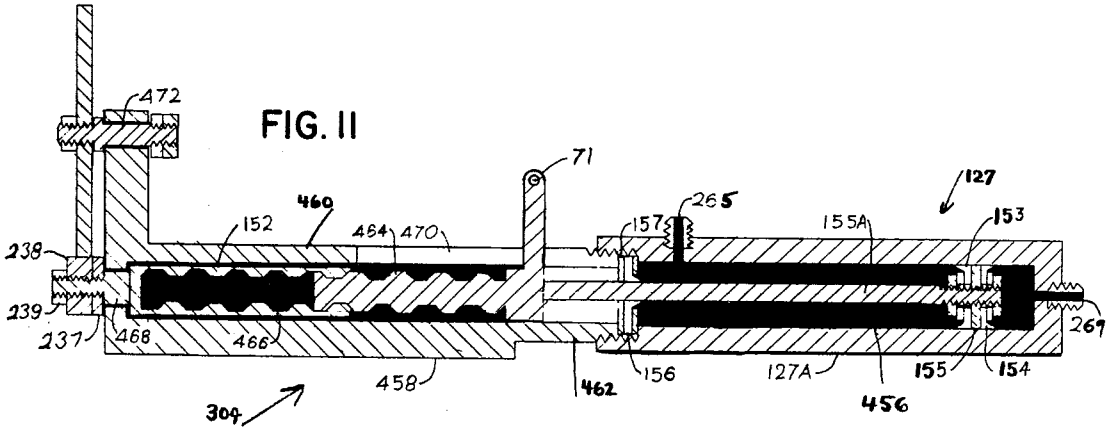
Figure 14:
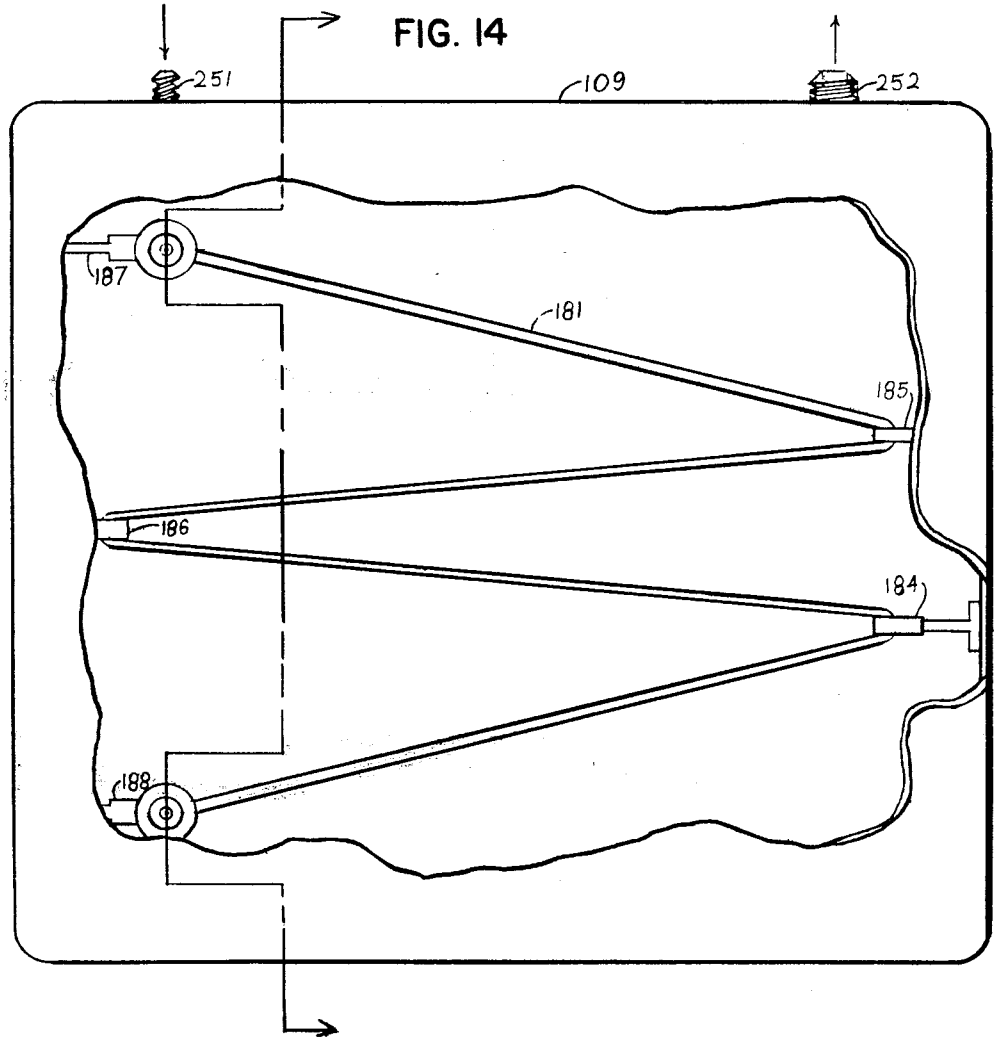
Figure 13:
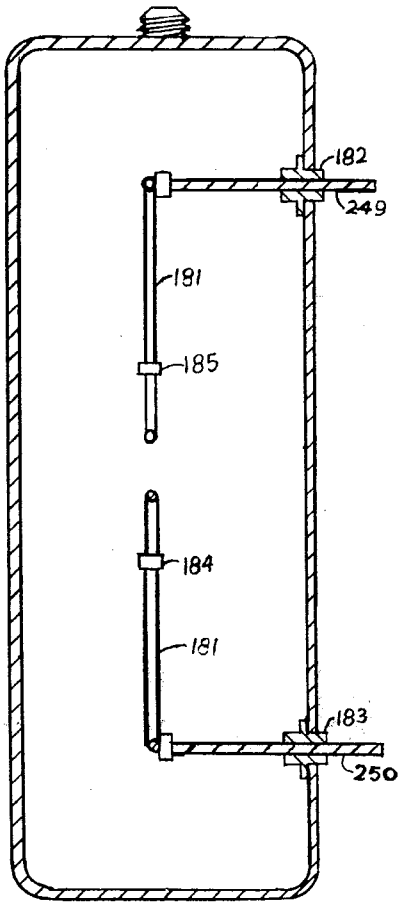
Figure 16:
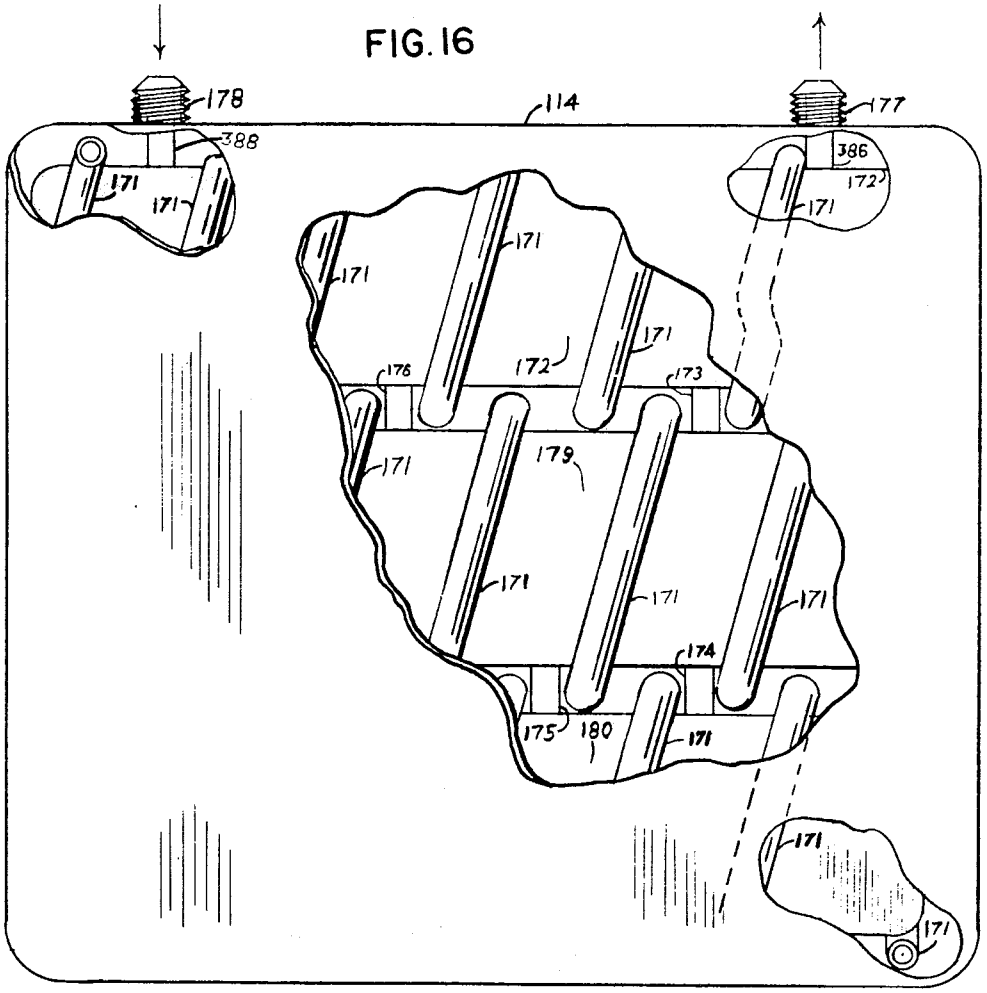
Figure 15:
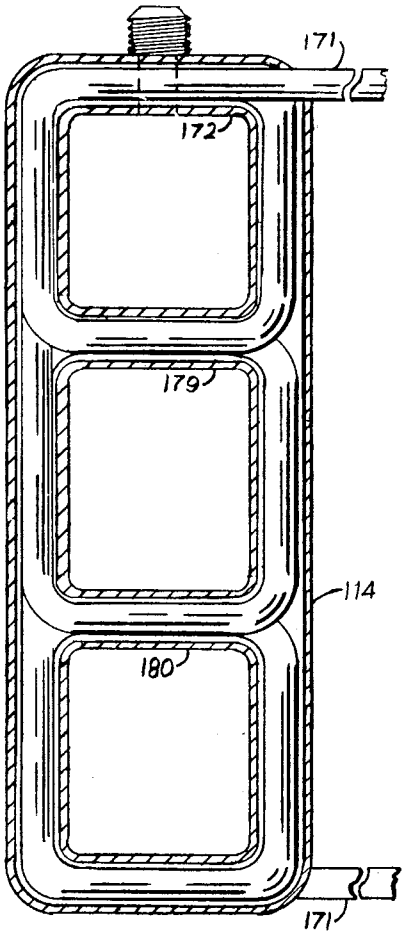
Figures 17, 18, 18A:
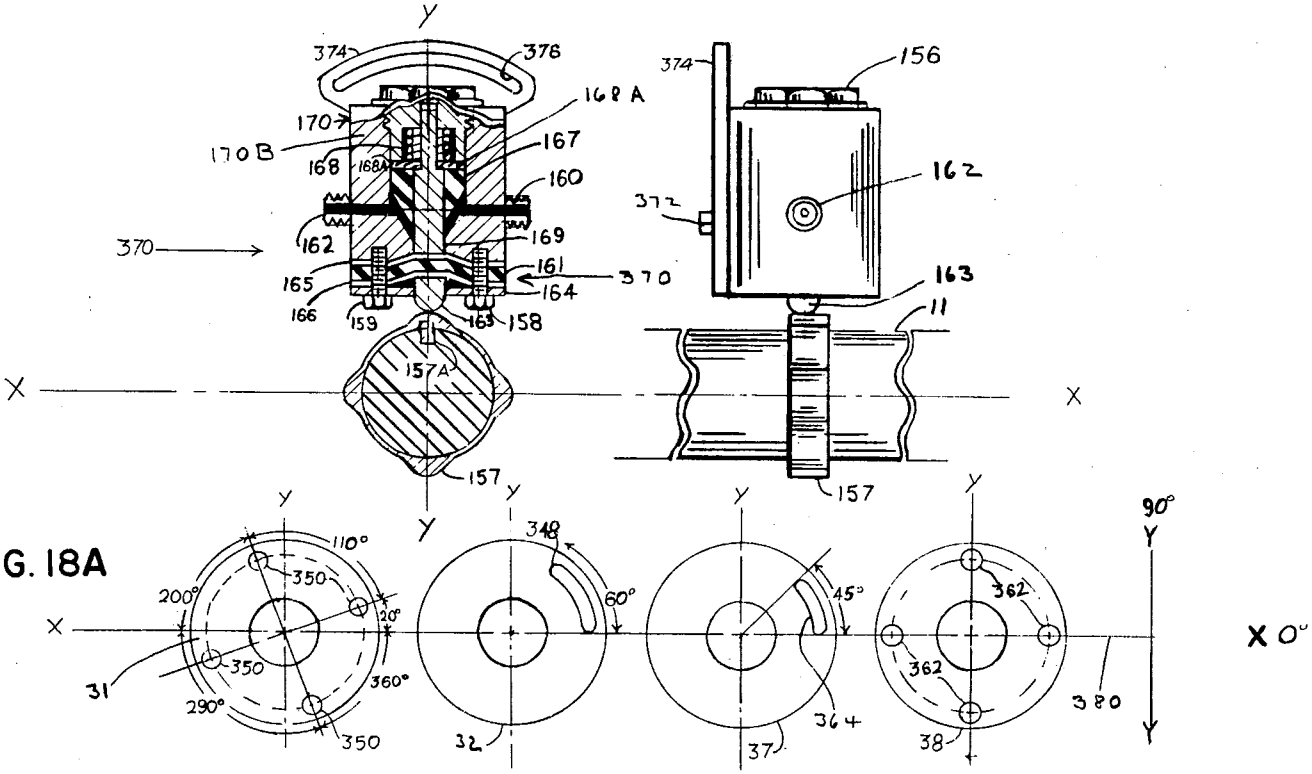
Figure 19:
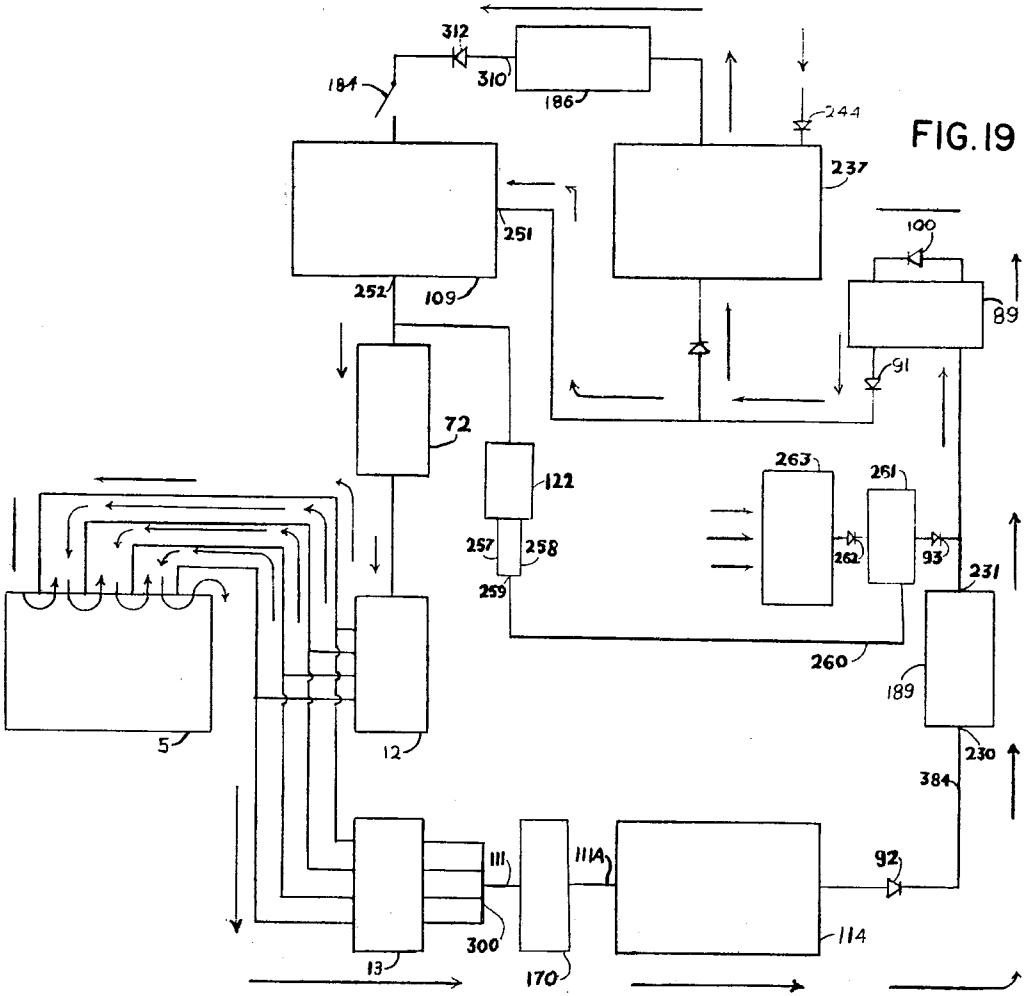
Figure 21:
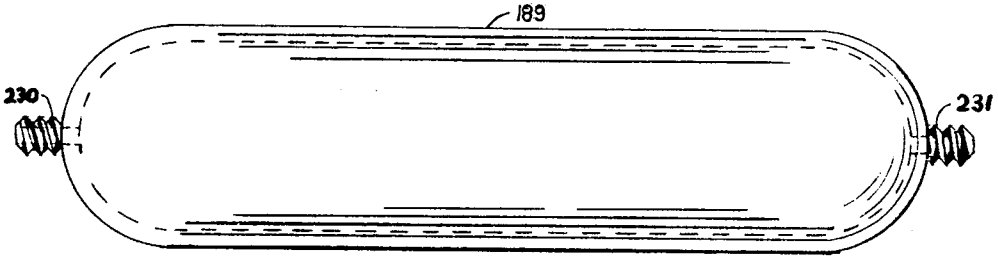
Figure 20:
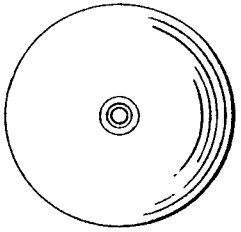
Figure 22:
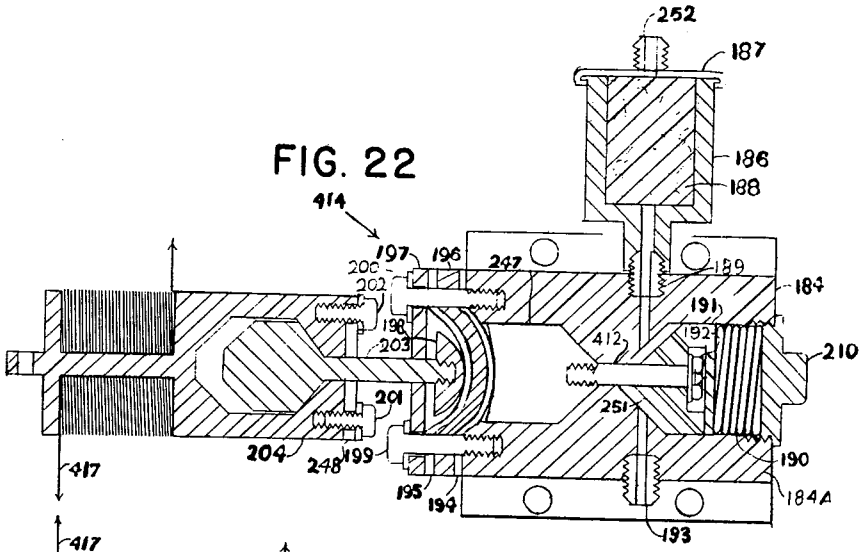
Figure 23:
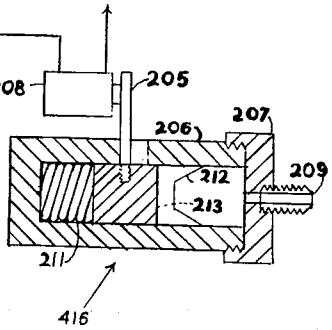
Figure 25:
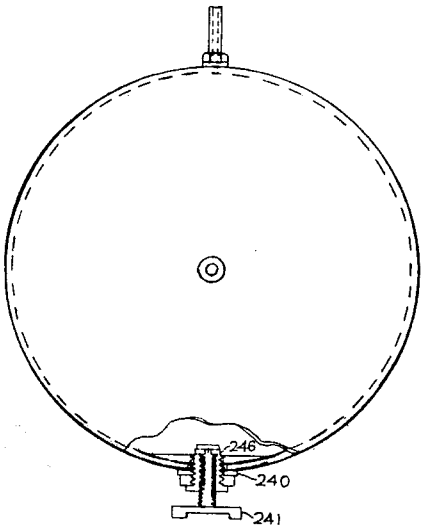
Figure 24:
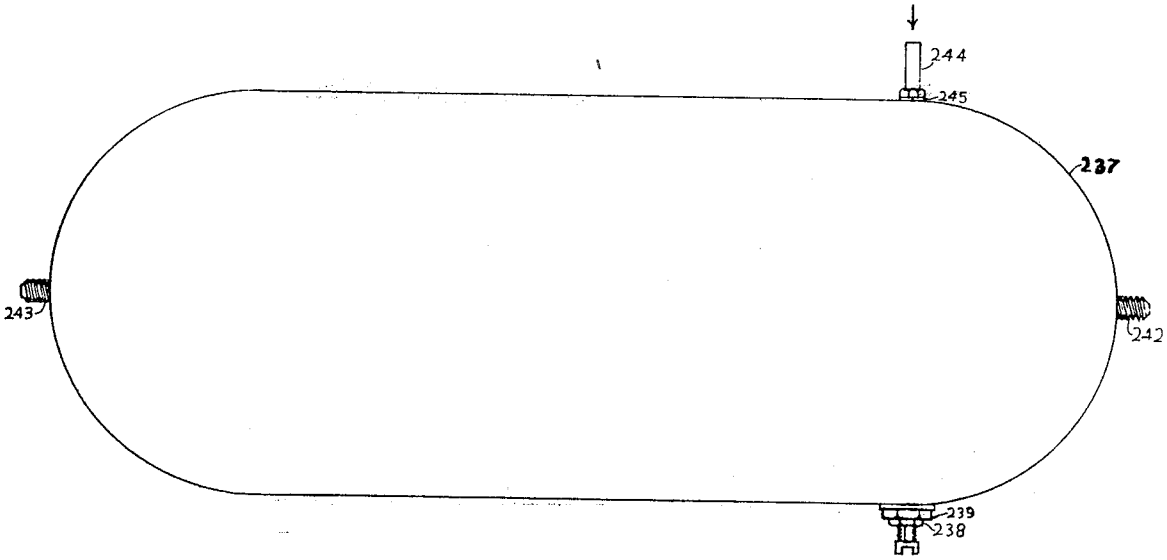
Figure 26:
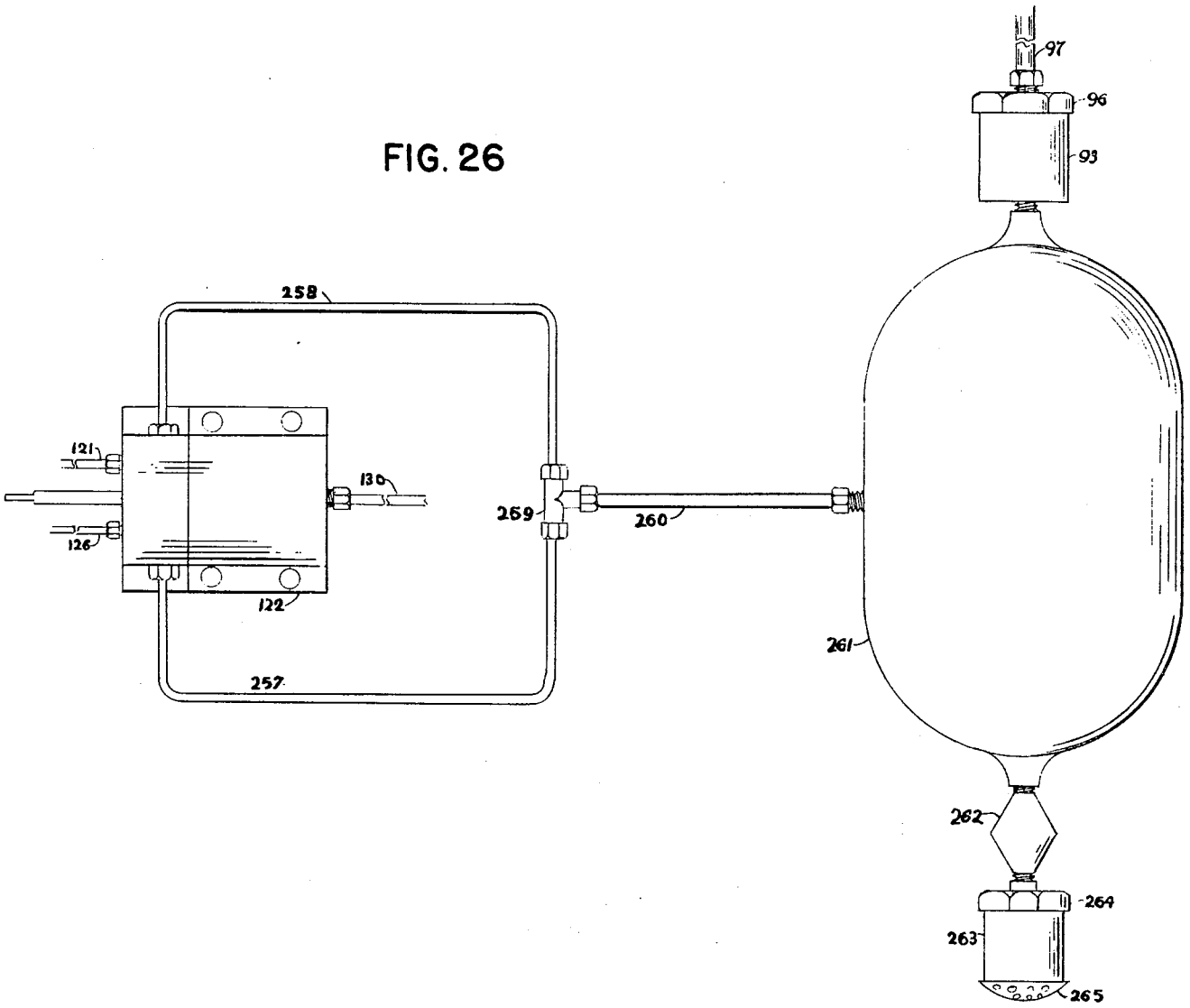
Figure 27:
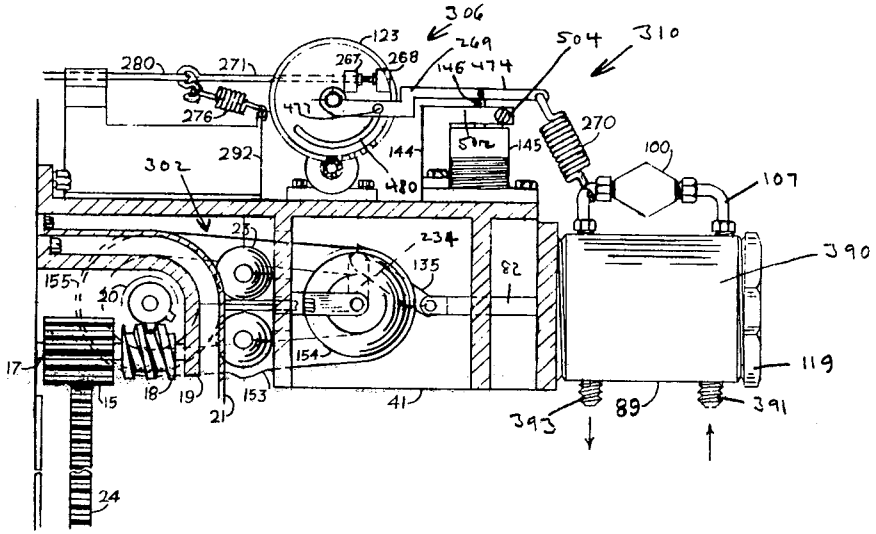
Figure 28:
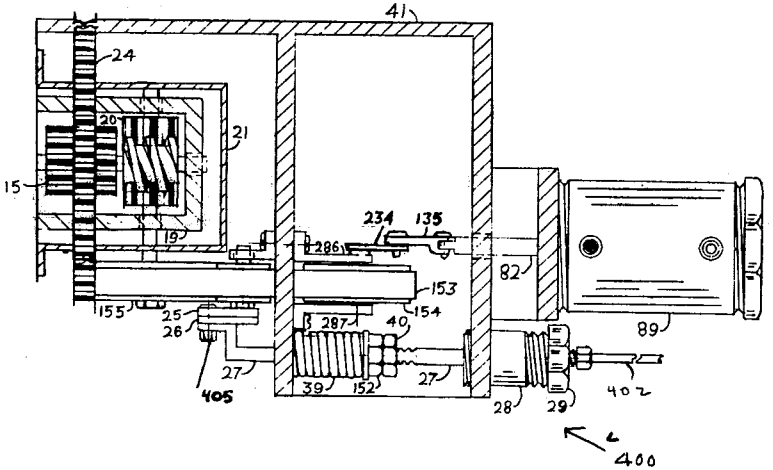
Figure 29:
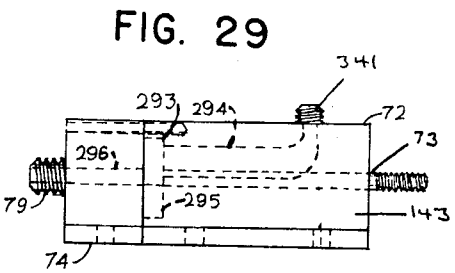
Figure 31:
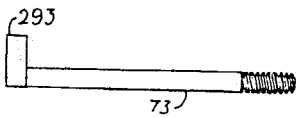
Figure 30:
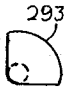
Figure 33:
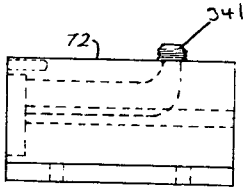
Figure 32:
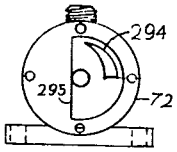
Figure 35:
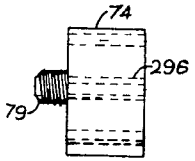
Figure 34:
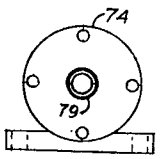

FIG. 4 diagrammatically illustrates an automatic clutch arrangement for driving the engine air pump, and a power adjustment for adjusting the horsepower of the engine that is operably associated therewith;

FIGS. 5 – 8 illustrate an air supply control lock valve employed in the illustrated embodiment in which FIG. 5 is a side elevational view of the value. FIG. 6 is a rear view of the valve, FIG. 7 is a front view of the valve; and FIG. 8 is a horizontal sectional view through the valve;

FIG. 9 is a wiring diagram diagrammatically illustrating the electrical control circuitry for the illustrated embodiment of the invention;

FIG. 10 is a top plan view of the motor drive control accelerator device of the illustrated embodiment, and a two way action air jack assembly employed to activate and deactivate same using the lock valve of FIG. 5 – 8;

FIG. 11 is a longitudinal vertical cross-sectional view of the drive control device of FIG. 10;

FIG. 12 is a view of the control device of FIGS. 10 and 11, taken from the right hand side of FIG. 10;

FIG. 13 is a transverse cross-sectional view of thepressure air tank of the apparatus from which air is controllably released to run the motor;

FIG. 14 is a side elevational view of the air pressure tank with parts broken away;

FIG. 15 is a transverse cross-sectional view of the motor apparatus vacuum tank container that is operably connected to the motor in conjunction with the pressure tank to run the motor, and showing the separate vacuum tanks associated with same in accordance with the illustrated embodiment;

FIG. 16 is a side elevational view of the vacuum tank container of FIG. 15, with parts being broken away;

FIG. 17 is a sectional view of the apparatus vacuum timer assembly, diagrammatically illustrating the components thereof, and in association with the crank shaft;

FIG. 18 is a side elevational view of the components shown in FIG. 17;

FIG. 18A is a diagram illustrating the principal components of the input and output timers and their orientation relative to the axis of rotation of the crank shaft for the timing functioning contemplated by the present invention;

FIG. 19 is a block diagram outlining the major components of the engine assembly, and indicating the operating direction of the air flows involved;

FIG. 20 is an end elevational view of a subvacuum tank employed in connection with the invention;

FIG. 21 is a side elevational view of the tank of FIG. 20;

FIG. 22 is a diagrammatic sectional view illustrating a control valve that is employed in connection with the spare pressure tank and associated parts;

FIG. 23 is a diagrammatic sectional view illustrating a pressure sensitive switch arrangement employed to control the valve of FIG. 22;

FIG. 24 is a side elevational view of the spare pressure tank;

FIG. 25 is an end elevational view of the spare pressure tank;

FIG. 26 is a plan view illustrating the lock valve arrangement of FIG. 5 and its incorporation in the air flow system to recycle the air passing through the lock valve;

FIG. 27 diagrammatically illustrates the apparatus air pump driving arrangement and several of the important control components of the engine, with parts shown in section;

FIG. 28 is a bottom plan view of the components shown in FIG. 27, with parts shown in section;

FIG. 29 is a side elevational view of the air limiter valve shown in section in FIG. 1;

FIGS. 30 and 31 illustrate the valve member of the air limiter valve;

FIGS. 32 and 33 illustrate the valve housing in which the valve member of FIGS. 30 and 31 operates; and, FIGS. 34 and 35 illustrate the valve inlet end of the air limiter valve.

However, it is to be distinctly understood that the drawing illustrations provided are supplied primarily to comply with the requirements of the Patent Laws, and that the invention is susceptible of other embodiments that will be obvious to those skilled in the art, which are intended to be covered by the appended claims.

GENERAL DESCRIPTION

Reference numeral 10 generally indicates one embodiment of the invention which comprises (see FIGS 1 – 3 and 19) an air operated engine 214 comprising an engine block 5 formed to operatively mount pistons 8, 53, 55 and 67, in the respective cylinders 8A, 53A, 55A and 67A that respectively receive the respective pistons. Engine block 5 also rotatably mounts drive shaft 11 to which the pistons are operably connected (see FIG. 1) for rotating the shaft whereby the engine 214 serves as a prime mover for a mechanism that may be suitable connected to the drive shaft 11 for the purpose of being driven thereby, for instance, at splined take off 11A.

In accordance with the invention, the apparatus 10 drives engine 214, by applying to the cylinders of same, for operably moving the pistons of the respective cylinders, heated compressed air for driving the pistons downwardly of their cylinders and, on the return strokes of the pistons, connecting the cylinders to a source of vacuum under refrigerated conditions. Thus, the engine pistons are actuated by unbalanced air pressure acting on same for both their driving and return strokes.

For this purpose, the apparatus 10 includes heated air pressure tank 109 (which serves as the primary source of compressed air under pressure for engine 214), which is connected to the engine cylinders through air limiting control valve 72, and a timer assembly 330 including air input timer 12 which includes ported seal 31 and cooperating valve plate 32 rotated by the shaft 11 for timing the supply of the heated air under pressure to the cylinders through an air flow connection system 14 including conduits 138, 193, 140 and 141 (see FIG. 2) leading between same and the respective cylinders.

Operably associated with the air flow connection system 14 is the output timer mechanism 13 that includes ported seals 36 and 38 on either side of valve plate 37 that is rotated by shaft 11. Timer mechanism 13 is connected by conduiting 115, 116, 117, and 118 to vacuum manifold 300 (see FIG. 3) which is in turn connected by conduiting 111 to vacuum timer 170 that is in turn connected by conduiting 111A to refrigerated vacuum container 114.

The input and output timer mechanisms 12 and 13, and the vacuum timer 170, are operated in the timed sequence to, for each individual cylinder, connect the cylinder to the source of heated air under pressure when the piston is at the height of its stroke, to drive the piston in cranking relation to the shaft to the lower end of its stroke, by which time the cylinder is connected to the source of refrigerated vacuum through the output and vacuum timers to draw the air from the cylinder above the piston out from the cylinder and thereby subjecting the piston in question to vacuum conditions within the cylinder for the return stroke of the piston. The vacuum timer 170 functions to seal of the output timer 13 from the source of vacuum when the output timer 13 closes communication of the air flow system 14 to the vacuum timer.

Operably associated with the engine 214 is two way air pump 89 which is operated by the shaft 11 through the drive and automatic clutch mechanism 302 (see FIGS. 4 and 27) to supply air to air pressure tank 109 as well as auxiliary or spare pressure tank 327. As indicated in FIG. 19, pump 89 draws the air to be supplied to the pressure tanks 109 and 237 from several sources, such as from vacuum tank 114 thrugh subvacuum tank 189, or from the air source tank 261, and is open through one way valve 262 (see FIG. 26) to the atmosphere, and which also receives air initiating from the air pressure tank for control purposes for recycling through the engine, as will be made clear hereinafter. One way valves 92 and 93 suitably restrict the air flow to the air pump from the vacuum side of the system, while one way valve 91 suitably restricts air flow from the pump to the main and spare pressure tanks on the pressure side of the system.

Figure 2:
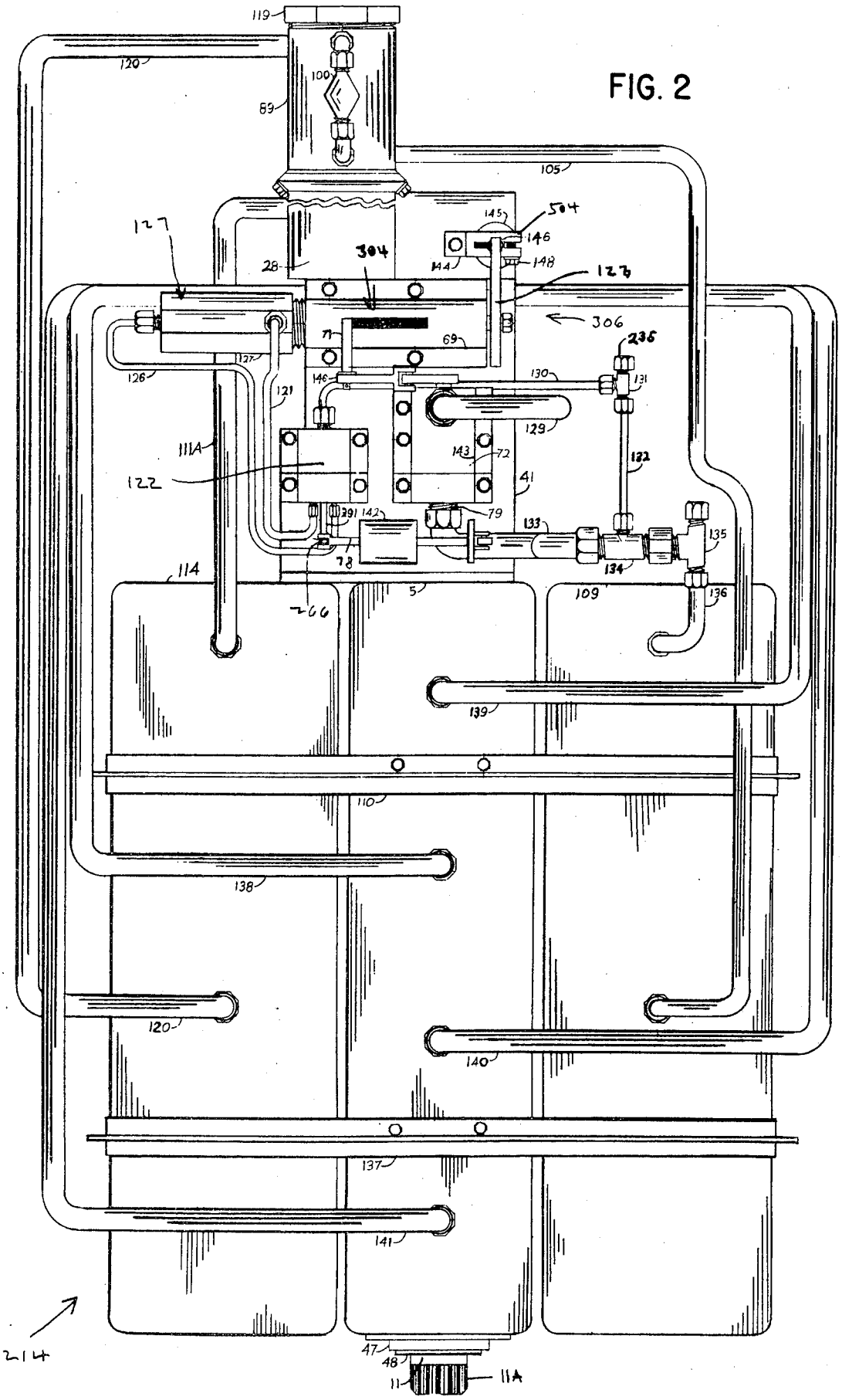
FIG. 2 is a top plan view of the air engine and its major associated components.

The flow of air under pressure from the main pressure tank 109 is provided by air limiter valve device 72, the operation of which is controlled by the air supply control lock valve arrangement 304 illustrated in FIGS. 10 – 12; arrangement 304 conditions the air limiter valve 72 to be adjusted when the motor is running to provide the speed of operation desired, and also conditions the air limiter valve 72 against operation beyond that which will accommodate only idling motion of the motor. This is done employing the reversible lock valve 122 of FIGS 5 – 8, operably arranged as indicated in FIGS. 2 and 11, to bias the air jack 127 against operation of the air limiter valve 72, or reverse the position of the air jack 127 to accommodate variable opening of the air limiter valve 72.

When the air supply lock valve 122 is in its air jack unlocked position, the air limiter valve 72 is adjusted through the acceleration mechanism 306 diagrammatically illustrated in FIGS. 12 — 12 and 27, which comprises an accelerator wheel 123 rotatably mounted to be moved counterclockwise of FIGS. 12 and 27 through an accelerator pedal or the like (not shown) controlled by the operator, and arranged to be spring biased in the direction of the arrow 308 of FIG. 12 to return the accelerator mechanism to idle position (such as suggested by FIG. 27).

Further in accordance with the invention, the apparatus 10 is conditioned for change between idling and shut off condition employing start up mechanism 310 (see FIG. 27), and including starting relay 145, and lock valve rely 142 (see FIG. 2) that forms a part of the mechanism 304. Start up mechanism 310 comprises swing arm 269 operatively connected to relay 145 and accelerator wheel 123 to condition the wheel 123 for movement to a position whereby the air jack 127 may fully close the air limiter valve 72, with the lock valve rely 142 being operative, utilizing the control circuit shown in FIG. 9, to position the valve 122 to dispose the air jack in its locking relation.

As indicated in FIG. 9, the apparatus 10 includes off-on control switch 312 that is operator controlled to condition the relays 142 and 145 for shut down of the apparatus 10, or alternately condition the apparatus 10 for the on and idling condition.

Further in accordance with the invention, the air pressure tank 114 is heated, as by including a suitable electrical heater incorporated in the control circuit of FIG. 9, with the inside of same being given a mirror finish for maximum retention of heat. The vacuum tanks of the container 109 are suitably refrigerated. It is preferred that the air in pressure tank 114 be at a pressure of about 200 psig (say in the range of 190–210 psig) and at a temperature range of 150° to 200° F., while the vacuum tanks should be at a temperature in the range of 20° to 40° F., and at a pressure of about 8 psig (say in the range of 6–12 psig); approximately 150° F. is preferred for the air pressure tank and approximately 30° F. is preferred for the vacuum tanks. Air entering the air pressure tank 109 expands, on being heated, within the tank 109 and thus increases the pressure of the tank, while air entering the vacuum tanks is cooled and thus decreases volume to accentuate the degree of vacuum present in the vacuum tanks.

The engine 214 is thus operated under unbalanced air pressures acting in opposition to each other and accentuated by the heating of the air under pressure and the cooling of the air under vacuum.

The spare tank 237 serves as a source of air under pressure when needed under the control of the pressure sensitive valve 184 (see FIGS. 19, 22 and 23), which functions to communicate the spare tank 237 to pressure tank 109 through filter 188 when the pressure of the tank 109 is reduced to a predetermined amount. The spare tank 237 may be also employed to start the engine after the apparatus 10 has been shut down for a prolonged period of time.

It will thus be seen that the invention is concerned with the producton of rotary driving motion from the effect of unbalanced gas pressures acting on reciprocating pistons in cranking relation to a drive shaft. No fuel, as such, is employed or needed to drive the engine 214, with obvious environmental benefits; operation costs are concerned with requirements to provide the unbalanced air pressures involved as well as the heating and cooling employed in connection with same. The engine includes its own air pressure and vacuum replacement mechanism which can be timed to keep the apparatus 10 in continuous operation for long periods of time. The air flows forming the source of motivation for the engine are contained within the conduit system of the apparatus and thus permit recycling of the motivating fluid and supplementing of same from the atmosphere as needed to maintain the pressure levels involved.

SPECIFIC DESCRIPTION

Referring now more specifically to the drawing details, the engine block 5 is suitably formed to define the cylinders 8A, 53A, 55A and 67A, which in the form shown open from the underside of the block to receive the respective pistons. The engine block 5 is also suitably formed for journaling of the shaft 11 along the underside of same, and for mounting the block in a suitable support (not shown).

The pistons are of identical construction, each (for instance, piston 67) including on the upper side of same a sealing cup 66 formed from a suitable rubber or plastic material and in air tight relation with the cylinder wall in which the cup 66 is mounted. The cup 66 is secured in place by metal mounting plate 215 made fast to the piston by suitable screws or the like (not shown). Applied to the underside of the piston is a sealing disc 64 also formed from a suitable rubber or plastic material and in air tight relation with the cylinder wall, and suitably secured to the piston by employing screws or the like (not shown). Journal pin 62 keys the piston 67 to the piston rod 53. Bearing sleeve 218 is interposed between the piston rod 63 and the shaft 11.

As indicated in FIG. 1, the four pistons illustrated are identical, with the four sealing cups being indicated by reference numerals 6, 52, 54 and 66, and the mounting plates therefor being indicated by reference numerals 215, 215A, 216 and 217, the lower piston seals being indicated by reference numerals 9, 50, 57 and 64, the journal pins being indicated by reference numberals 10, 51, 58 and 62, and the piston rods being indicated by reference numerals 7, 49 and 63 (the rod for piston 55 being omitted), the bearing sleeves for the journal pins being indicated by reference numerals 59, 60, 61 and 65, and the shaft bearing sleeve being indicated by reference numerals 218 and 222 for the pistons 8 and 67, it being understood that the other pistons have similar bearing sleeves.

The crank shaft 11 is rotatably mounted on the engine block 5, in the illustrated embodiment, by applying same to ball bearing units 45 and 98 that are suitably secured to the engine block as by employing the conventional semi-circular clamp devises indicated at 224 and 226, respectively suitably bolted to the engine block 5. Similar clamp devices 226, 227, and 228 applied to the engine block 5 intermediate the devices 224 and 223, in conjunction with the respective bearing sleeves 219, 220 and 221, to effect further journaling of the crank shaft 11 to the engine block 5.

Applied to the underside of the engine block 5 and covering the crank shaft 11 is oil pan 46, with both ends of the crank shaft 11 extending beyond the oil pan 46 at either end of the engine block. The oil pan 46 is suitable secured to the engine block 5 without making direct contact with the crank shaft 11. At the rear of the block 5, mounting plate 47 mounts oil seal 48 that is in wiping engagement with the crank shaft and closes off the engine 214 at the rear side of same. At the front of the engine, cover plate 21 is suitably secured to the engine block 5 and suitably mounts oil seal 43 that is likewise in circluing wiping engagement with the crank shaft 11 and closes off the engine 214 at the forward end of same. The engine 214 contains lubricating oil about the shaft 11 approximately to the level indicated in FIG. 1.

Figure 3:
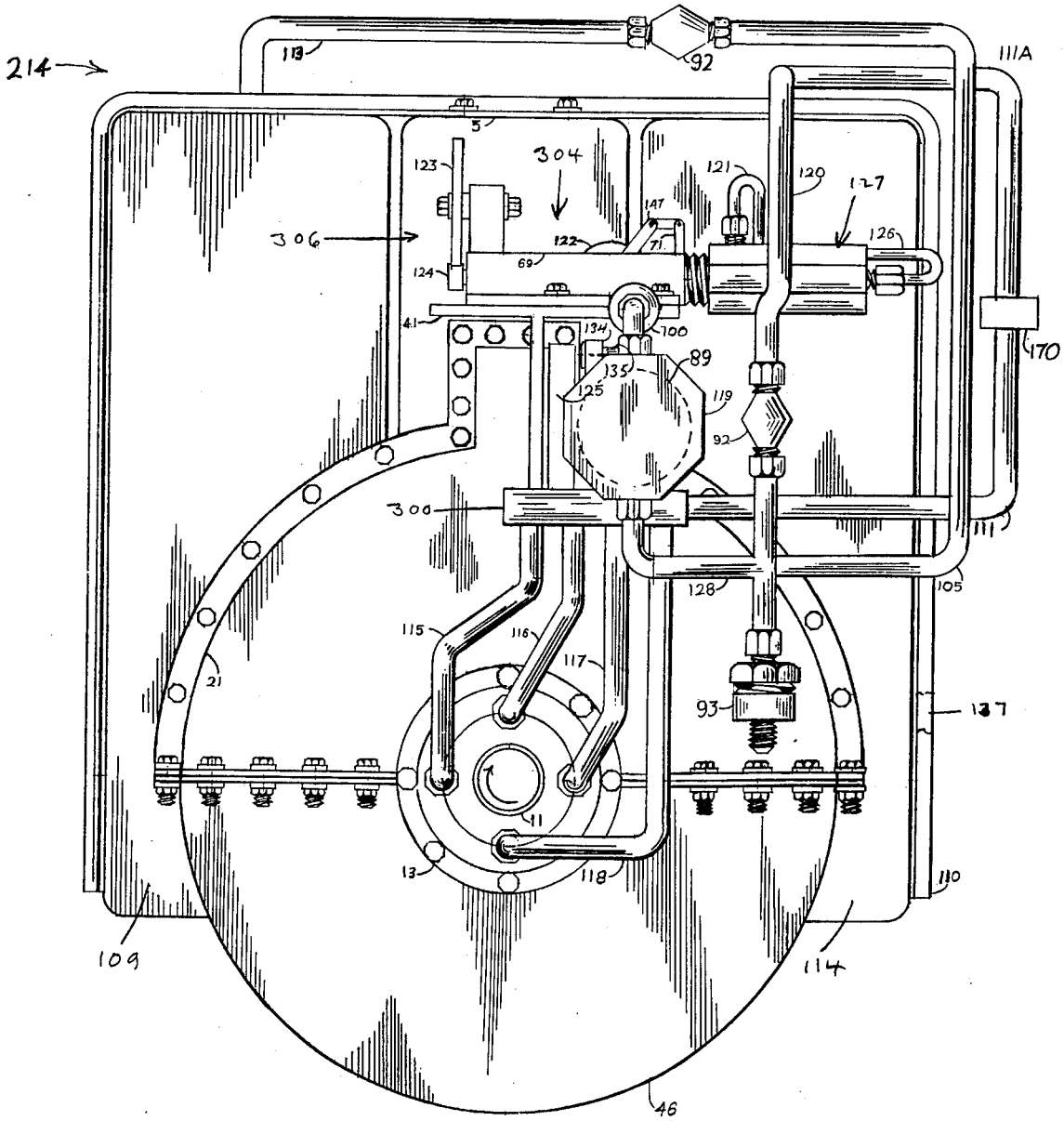
FIG. 3 is a front elevational view (taken from the right hand side of FIG. 1) of the engine apparatus, with some components being shown in diagram form.

As indicated in FIG. 1, at the top of the engine block and in axial alignment with the respective cylinders 8A, 53A, 55A and 67A are tubular fittings 1 – 4, respectively, for providing for the fluid flow into and out of the respective cylinders that is contemplated by this invention. The fittings 1 – 4 are individually connected to the timer assembly, that is generally indicated by reference number 330 of FIG. 1, by the conduits 138, 139, 140 and 141 (see FIGS. 2 and 3). The rotation of the crank shaft 11, which is clockwise of FIG. 3, is governed by employing the three timer units of assembly 330, namely the input timer unit 12 (asee FIG. 1), the output timer 13, and the vacuum timer 170 (see FIGS. 17 and 18).

The timer assembly 330 comprises housing sections 332, 334 and 336 that are flanged as at 338 for securement together bye employing suitable bolts or the like (not shown), with suitable separator plates 33 and 35 being employed between adjacent sections, as indicated in FIG. 1. The housing section 332 is suitably affixed to mounting bracket 30 that is in turn secured to the cover plate 21 and oil pan 46 by employing appropriate bolts or the like (not shown).

The housing section 332 includes fitting 340 to which is applied the air discharge end of conduit 129 leading from the fitting 341 (see FIG. 29) of air limiter valve 72.

The housing section 332 is sealed on the engine block side of same by appropriate seal 108 held in place by suitable holder 42, and on the outwardly facing side of same is mounted the cylinder input timer 12 that comprises a valve plate 32 keyed to crank shaft 11 by suitable key 34 and disposed within the seal 31, formed of rubber or other suitable fluid sealing material and comprising disc 344 that is applied against gasket 33, and is recessed to receive the valve plate 32, which has a covering 346 of a suitable fluid sealing material, such as rubber. As indicated in FIG. 18A, wherein the major components of the timer devices 12 and 13 are shown in block diagram form, the valve plate 32 is formed with an arcuate port hole or opening 348 that is struck about an arc concentric with the axis 380 of rotation of the crank shaft 11 and has an arc length of 60° . The valve plate hole or opening 348 is aligned longitudinally of the crank shaft 11 and radially of same for establishing communication between same and the four apertures 350 of the seal 31 that are spaced 90° apart about the axis of the shaft.

separator plate 33 is formed with apertures (not shown), located similarly to and aligned with the apertures or openings 350 of the seal 31, to which discharge fittings 352 are applied for discharging the air flow from the input timer into the air conduit system 14.

The output timer 13 comprises valve plate 37 that is interposed between seals 36 and 38 within the housing section 336, with the valve plate 37 having suitable fluid seal liner 360 applied thereto. The separator plate 35 and the seals 36 and 38 are each formed with four apertures spaced 90° apart, as indicated for apertures 362 of seal 38 in FIG. 18A, which are disposed in alignment axially and radially of the shaft 11. The valve plate 37 is formed with a single aperture or opening 364 that is proportioned to be 45° in arcuate length on an arc struck about the axis 380 of shaft 11. The valve plate opening 364 is located radially of the valve plate 37 for alignment with the indicated port openings of the seals 36 and 38. The housing section 336 is ported in alignment with the seal openings 362 and has applied thereto in alignment with respective the ports thereof fittings 366 to which are suitable secured the respective conduits 115, 116, 117 and 118 (see FIG. 3) that lead to vacuum manifold 300, and which in turn is connected by conduit 111 to the vacuum timer 170 that is in turn connected by conduit 111A to the source of vacuum (in this instance, container 114).

The vacuum timer 170 in the illustrated embodiment is operably associated with the crank shaft 11 and while it is not shown in FIG. 1, this was for convenience of illustration, as in practice, in the embodiment illustrated, the vacuum timer be mounted in the operating space of engine 214 indicated by reference number 170A in FIG. 1.

In any event, as indicated in FIGS. 17 and 18, the vacuum timer 170 comprises the lobed cam member 157 keyed to the shaft 11 by suitable key 157A, with cam follower 163 being spring biased against the cam 153 by compression spring 168 housed within housing body 170B in which is also mounted the valve member 167 having a sealing portion of conical configuration for sealing cooperation with a like shaped sealing surface of the housing 170B, whereby communication between the two fittings 160 and 162 is interrupted by the valve member 167 under the action of biasing spring 168 (which seals against spring seat 168A) that has biasing action both on cam follower member 163 and the valve member 167. In the form shown, the cam followed 163 is affixed to gasket 370 secured in place to the housing 170B over the open end of housing opening 169 by employing suitable bolts 158 and 159 acting against cover plate 164. The gasket 370 comprises stiff sheets 165 and 166 of a suitable plastic on either side of a core layer 161 formed of a rubber material that is firm and flexible to provide a composite gasket 370 of long wearing flexible characteristics. The cam member 163 is adhered to the gasket 370 in any suitable manner. The housing 170B is closed at its other end by suitable end cap 156 which is arranged for air tight connection to the housing 170B.

The housing 170B has affixed thereto, by employing suitable bolts 372, a suitable bracket plate 374 formed to define arcuate mounting slot 376 which is suitably mounted on a fixed support member, such as the component 30 of the timer assembly 330, so as to be adjustable about the axis of shaft 11, that is circumferentially of the shaft 11, for timing the operation of timer 170 relative to the operation of timers 12 and 13.

In the showing of FIG. 3, the timer unit 170 is shown in block diagram form to simplify illustration.

The orientation of the components forming the timer units 12 and 13, relative to each other and the shaft about the circumference of the shaft, and the location of the cam member 157 of the vacuum timer unit 170 are related to maximum effective operation of the engine. Assuming that the X—X axis of the transverse cross-section configuration of the shaft 11 is horizontally disposed, as illustrated in FIGS. 17 and 18A, for use as a reference position, an appropriate timing position of the components of the respective timers would be as follows:

For the timer unit 12, the openings corresponding to openings 350 should be disposed, measuring clockwise from the right hand segment of the X—X axis as illustrated in FIG. 18A (as the zero degree positioning), at the 20°, 110°, 200° and 290° positions about the axis 380 of the shaft 11 that are indicated in FIG. 18A.

The ports corresponding to ports 362 of the timer 13, and the protuberances of cam member 157 of timer 170, should have correspondingly similar locations, with the result that when the respective pistons are at the upper ends of their strokes, the piston cylinder involved is connected to the source of compressed air through the input timer 12 and air flow conduiting 14, and as the pistons reach their lower positions in their cylinders, the respective cylinders are connected to the source of vacuum through the air flow conduiting 14, output timer 13, and vacuum timer 170. The conduiting 14 comprises the respective conduits 138, 139, 140 and 141 being respectively connected to T-fittings of the type diagrammatically illustrated in FIG. 1 (in the illustrated embodiment) connecting the fittings 352 and 352A of separator plates 33 and 35, that lead to the timer parts that are to be connected to the respective cylinders 8A, 53A, 55A, and 67A, of block 5, through housing section 334.

The general arrangement of the source of vacuum is indicated in FIGS. 15 and 16, wherein container 114 is shown provided with fittings 177 and 178 for connection to the air flow system involved, with the conduit 111A leading from the vacuum timer being connected to the fitting 178, and the fitting 177 being connected to the subvacuum tank 189 through conduit 384 (see FIG. 19) which conduit includes suitable one way throw valve 92.

In the specific vacuum container arrangement illustrated, the container 114 has mounted in same three vacuum tanks 172, 179, and 180 that are interconnected by a plurality of junction pipes, such as those indicated at 173, 174, 175, and 176. Junction pipes 386 and 388 connect the tank 172 to the respective fittings 177 and 178. Suitable tubing 171 for circulating refrigerant about the tanks 172, 179 and 180 is coiled about the respective tanks. The conduiting 171, which may be formed from copper, is connected in a suitable refrigeration system such as a conventional automobile type air conditioner operating with Freon as the refrigerant. The refrigeration system employed is operated as is necessary to keep the temperature within the tanks 172, 179 and 180 at the 10° to 20° F. range that has been indicated.

FIGS. 20 and 21 diagrammatically illustrate the subvacuum tank 189, with the conduit 384 being connected to the tank 189 at fitting 230 and the fitting 231 being connected to the pump 89 in the manner suggested in FIG. 19.

The air pump 89 is of the push pull type (see FIG. 1) and comprises housing 390 (having end cap 119) to which conduits 97 and 105 are connected on either side of the pump piston 88 at the respective fittings 391 and 393. The opposite sides of the piston 88 communicate through conduits 106 and 107 that are connected together at one way flow valve 100 containing flow check member 104. Conduit 105 includes one way flow valve 91 containing check valve member 103. When the pump piston 88 moves to the left of FIG. 1, valve 100 closes and valve 91 opens to communicate the pressure side of the pump to the pressure tank 109 through suitable conduiting diagrammatically illustrated in FIG. 19. This action draws air into the low pressure side of the pump through valves 93, 99, or 92, depending upon the pressure differential relations involved in each instance which result in the respective valves opening the easiest. As indicated in FIG. 1, valve 93 comprises suitable valve housing 96 connected to conduit 97 and employing a valve member 94 seated against the valve orifice by compression spring 95. Valve 99 includes one way acting valve member 101 while valve 92 includes one way acting member 102. Conduit 90 connects the subvacuum tank 189 to conduit 97 in the specific arrangement indicated in FIG. 1.

With reference to the specifics of the air pump 89 itself, the pump piston 88 comprises piston rod 82 extending through the rod end 394 of the housing through suitable air tight seal 81. The piston 88 is threaded on the threaded end of the piston rod 82 and has seal members 85 and 86 (see FIG. 1) mounted on either side of same. Nut 83 bearing against clamp plate 84 clamp seal 85 to the piston 88, while nut 232 bearing against clamp plate 87 clamps seal 86 against the piston, with the nuts 83 and 82 thus fixing the piston 88 in operating position on the piston rod 82. Rod seal 81 is suitably secured in place as by employing adhesive.

As previously indicated, the air pump 89 is operated by engine 214, and for this purpose crank shaft 11 has keyed thereto, by employing suitable key 44, a fly wheel 24 (see FIGS. 1 and 27), having its rim toothed for meshing relation with pinion gear 15 keyed to a shaft 17 journaled between the engine block and frame member 19. Also keyed to shaft 17, using a common key 68, is worm gear 18 meshing with worm 20 that is keyed to the pulley wheel 155 (see FIGS. 4 and 27) of automatic clutch assembly 302 which drives pulley belt 153 trained over a second pulley wheel 154 to which is operatively connected a drive arm 234 connected to operating rod 135 (see FIGS. 27 and 28) connected to pump piston rod 82 in reciprocating relation thereto.

The pulley belt 153 has operably associated therewith the automatic clutch device 400 that is diagrammatically illustrated in FIGS. 1 and 4, which includes pressure sensitive actuator device 29 comprising housing 28 suitably connected to the pressure tank 109 through conduit 402 and receiving the piston head 404 (see FIG. 1) of actuating rod 27 which extends outwardly of the housing 28 and has pivotally connected to same a pair of oppositely acting swing arms 25 and 26 that respectively pivotally mount the rollers 22 and 23 which are adapted to engage the inside surfacing of belt 153. The arms 25 and 26 and pivotally connected at 405 and spring biased to the folded position indicated in FIG. 4.

The actuator rod 27 is biased inwardly of the housing 28 by compression spring 39 acting between mounting wall 406 and spring seat 156 that seats against adjustment nut 40 threadedly mounted on the rod 27. The pins 407 and 409 that journal the respective roller 22 and 23 (on arms 25 and 26) ride in the respective rectilinear guide ways 274 and 290 forward in the adjacent housing structure wall 411 (that are longitudinally aligned).

The device 400 is adjusted so that at normal operating pressures in the air pressure tank, the spring 39 is overcome to permit the arms 25 and 26 to be biased to their folded relation whereby the rollers 22 znd 23 will be out of stretching relation with the belt 53. However, when the pressure in the air pressure tank reaches a predetermined minimum, the spring 39 will be effective to move the rod 27 sufficiently to the right to spread the arms 25 and 26 so as to bring the rollers 22 and 23 into the relative positions shown in FIG. 1, whereby the belt 153 drives pulley 154.

The air pressure tank 109 is shown in FIGS. 13 and 14 and thus is provided with fittings 251 and 252 to accommodate air flow into and out of the pressure tank, respectively, with the pressure side of the air pump 89 being connected to the fitting 251 and the fitting 252 being connected to the air limiter valve 72.

As previously indicated, the air under pressure is to be heated, and for this purpose tank 109 is equipped with a suitable means for heating the air, such as the electrical heating element 181 having one of its ends electrically connected to lead 249 entering the pressure tank 109 through suitable insulator 182, and having the other of its ends electrically connected to lead 250 that enters the pressure tank through suitable insulator 183. Heating element 181 is suitably mounted in spread out relation with the thank by suitable supports 184, 185, 186, 187 and 188. The heating element 181 may be energized in any suitable manner and in the illustrated embodiment is incorporated in the control circuiting shown in FIG. 9.

Connected in parallel with the pressure tank 109 is the spare pressure tank 227 (see FIG. 19). FIGS. 24 and 25 illustrate the spare pressure tank 237, which is equipped with inflow fitting 243 and outflow fitting 242. Tank 237 may be provided with the suitable fitting and valve arrangement indicated at 238, 239, 240 and 241 to effect removal of water accumulating in same, as well as one way flow valve 244 (shown in block diagram form only) that forms an out flow blocking intake port for receiving compressed air externally of the engine air flow system.

As indicated in FIG. 19, the spare assembly tank 237 is connected to the pressure tank 109 through suitable conduiting 310 equipped with suitable filter 188, one way valve 312, and off-on pressure operated valve 184, the specifics of the latter being shown in FIGS. 22 and 23.

The valve 184 comprises valve body 184 mounting valve member 251 that is spring biased by spring 190 to close communication between the fittings 189 and 193. The fitting 189 has applied to same filter unit 186 including filter material 188 contained within housing 187 equipped with fitting 252 to which the conduiting 310 is connected. Fitting 193 is connected to the air pressure tank 109.

Spring 190 is seated between valve body closure cap 210 and spring seat 192 that bears against the valve member 251. The valve member 251 is connected by stud 412 to member 247 that is actuated by relay 204 having an actuator rod 203 equipped with a spherically contoured push element 198 that cooperates with diaphragm structure 414 suitably affixed in sealing relation to the housing 184A by suitable bolts 199 and 200 cooperating with clamp plate 197. Diaphragm structure 414 comprises wear resisting plastic sheets 194 and 195 on either side of core member 196 formed from a suitable rubber material of good wearing characteristics and adapted to be deflected against the valve member 247 on actuation of the relay 204.

Relay 204 is controlled by the pressure operated device 416 of FIG. 23 comprising housing 206 in which piston 213 equipped with suitable seal 212 is reciprocably mounted and biased in the direction of the housing cover 207 to which fitting 209 is applied for connecting the pressure tank 109 to the housing 206. The piston 213 carries switch arm 205 operably engaging switch 208 that is electrically connected to the operating coil of relay 204 by lead 417. The arrangement is such that the spring 211 holds the switch arm 204 from closing switch 208 until the pressure in the pressure tank 109 reaches a predetermined minimum, whereupon the relay 204 is operative to move the valve 184 to the open position indicated in FIG. 22 for communicating the spare pressure tank 237 to the pressure tank 109. The switch 208 and the coil of relay 204 are connected in the electrical system in the manner indicated in FIG. 9.

The air limiter valve 72 (see FIGS. 1, 2 and 29–35) comprises a housing 143 mounting a hard rubber body 430 in which is journalled swing rod 73 that carries valve member 293 formed to control the air flow into and through arcuate air passage 294 extending through the valve 72 to fitting 341; valve member 293 is mounted in operative relation with closure plate 74 to which is affixed fitting 79 that is connected to the air pressure tank 109 in the manner indicated in FIG. 2, utilizing conduit 136, fittings 135 and 134, and conduit 133. Closure plate 74 is suitably fixed to housing 143. Valve member 293 operates within recess 295 of body 430 that is closed by plate 74. Plate 74 is formed with passage 296 communicating between fitting 78 and recess 295. The rod member 73 is tightly engaged within the body 430 for fluid sealing reasons and is rotated about its longitudinal axis through crank arm 70 fixed thereto to operate the same. Because of the tightness of fit involved, the present embodiment of the invention utilizes the air control actuation mechansim 304 (see FIGS. 10 – 12) to operate the valve 72. As already indicated, the actuation mechanism 304 involves the reversing air supply control lock valve 122 (see FIGS. 5 – 8) operatively associated with the air jack 127 to shift its piston 155 with respect to the air jack housing 127A so as to air bias the air jack piston 155 and its piston rod 155A so as to permit the control device 310 (see FIGS. 12 and 27) to operate the air limiter valve 72 to increase and decrease the rate of air supply thereto above that which would generate idling of the engine.

The lock valve 122 (see FIGS. 5 – 8) comprises a valve body 122A formed to define passages 440 and 442 diverging from fitting 253 that is connected to the pressure tank 109 through conduit 130 (see FIG. 2), T-fitting 131, conduit 132 and T-fitting 134 that is interposed between the conduits 133 and 136 leading to the air intake end of the air limiter valve 72.

Valve body 122A has an end portion 443 secured thereto by bolts 151 which is recessed as at 444 to receive a disc type valve member 150 which is fixed to shaft 149 extending through the end portion 443 for connection to level arm 266 (see FIG. 2) that is in turn actuated by the thrust rod 78 of relay 142 which is fixedly mounted in its operative position suggested in FIG. 2 in any suitable manner. The disc valve 150, which has a fluid sealing covering 445 of hard rubber or the like, is formed with a single cross passage 448 that is adapted to be swung between cross passages 450 and 452 of the housing end member 443 for alternately connecting the fittings 254 and 255 to the housing fitting 253. As indicated in FIGS. 2 and 11, the fitting 254 of valve 122 is connected to the fitting 265 of the air jack 127, while the conduit 126 connects the fitting 254 of valve member 122 to the fitting 269 of the air jack 127.

The air jack 127 comprises housing 127A formed to define cylinder 456 in which the piston 155 reciprocates. Piston 155 includes seal elements 153 and 154 suitably affixed thereto as indicated in FIG. 11. Piston rod 155A extends outwardly of the housing 127A through end wall 156 of the accelerator wheel mounting assembly 458 which defines a cylindrical housing portion 460 having an end portion 462 threaded for threaded application to the threaded end portion 157 of the housing 127A whereby these two housings are secured together.

Integral with the rod 155A is the actuation arm 71 that is operatively connected to the air limiter valve 72 (see FIG. 1) for actuating same, which is also integral with a screw portion 464 threadedly received in internally threaded screw portion 466 of rotable member 468 journaled in the housing portion 460 and having a gear 238 keyed to same that meshes with the accelerator wheel 123. Nut 239 seats the gear 238 against lock washer 237 that in turn is seated against the rotable member 468 to key the gear 238 to the rotable member 468.

The arm 71 operates in elongate slot 470 of the housing portion 460, and is suitably connected to crank arm 70 for pivoting rod 73. In the position of the valve member 122 wherein the air jack is to be biased against opening the air limiter 72 beyond an engine idling feed, the air pressure fluid from the pressure tank is to pass through passage 442 through fitting 255, conduit 121 and fitting 265 to dispose the piston 155 and rod 155A in the position of FIG. 11, whereby when the electrical control system shown in FIG. 9 has its control switch 312 switched to the off position, the accelerator wheel 123 will act to rotate member 468 to fully close the air limiter 72, with the air jack 127 acting to hold it closed through arm 71.

In the alternate position of the valve 122, passage 440 is connected to fitting 254 and thence through conduit 126 to fitting 269 to bias the piston 155 and rod 155A for movement in the opposite direction, whereupon movement of the accelerator wheel 123 counterclockwise of FIG. 12 will rotate member 468 so as to move rod 71 to open air limiter 72 as desired.

The accelerator wheel 123 is suitably journaled on the housing 458 for meshing engagement with the gear 238 and is biased for movement in the direction of the arrow 308 (see FIG. 12), as by employing a suitable biasing spring 276. In the form shown the accelerator wheel 123 has rod 271 pivotally connected thereto (by a suitable pin, not shown), which rod 271 is pivotally connected to rod 280 slidably mounted in guide block 292 and connected to a suitable operator controlled accelerator of the pedal type, arranged such that when the accelerator is pressed by the operator to power engine 214, rod 280 is pulled to the left of FIG. 27. Tension spring 276 connected between rod 271 and block 292 spring biases accelerator wheel 123 in the direction indicated by the arrow 308 of FIG. 12. The accelerator wheel 123 is suitably keyed to shaft member 472 (see FIG. 11) whichd also swingably mounts swing arm 269 having its end 474 connected to push arm 146 of the starting relay 145 which is suitably operably mounted for shifting swing arm 269 upwardly of FIG. 27 a predetermined amount. Swing arm 269 carries pin 477 normally engaging the end 478 of the elongate slot 480 formed about the margin of the accelerator wheel in which pin 477 rides when the accelerator wheel 123 is moved counterclockwise of FIGS. 12 and 27 during power operation of the engine. The function of the starting relay is to shift the swing lever 269 sufficiently (upwards of FIG. 27) to move the accelerator wheel 123 counterclockwise just enough to open valve 72 to idle position. Swing arm 269 is biased against arm 475 by tension spring 270

The starting relay 145 is operated by a pair of switches 267 and 268, with the switch 268 being of the normally open type and carried by wheel 123, and switch 267 being of the normally closed type and being fixedly mounted adjacent same, and with their switch arms in contact in the fully off position of wheel 123, the arrangement being such that when the engine operator moves switch 312 from the off to the on position, relay 145 will be energized to upwardly thrust swing arm 269 and hold same so that swing arm pin 477 prevents the accelerator wheel from returning clockwise sufficiently (under spring 276) to fully close down the air limiter valve 72. This movement closes switch 267 and opens switch 278, which has the effect of energizing relay 142 to actuate its thrust rod 78 to position the valve 122 in the position of FIG. 8; thereafter, during motor operation, counterclockwise rotation of the accelerator wheel 123 by the operator pressing the accelerator pedal to pull rod 280 to the left of FIG. 22 will bring the air motor up to desired speed.

The motor is returned to idle speed by the operator releasing the accelerator pedal so that spring 276 can move the wheel 123 clockwise until the end 478 of slot 480 engages pin 477 of swing arm 269. The engine 214 can be repeatedly brought up to desired speed by tensioning pull rod 280 as necessary. When the engine is to be shut off, switch 312 is moved to the off position which reverses relay 145 to actuate its rod 146 to lower arm 268 to its "off" position, whereupon the bias of spring 276 brings switch 268 into engagement with switch 267 to close switch 268 and open switch 267 to reverse the position of valve 122, whereby the air jack 122 assumes the position of FIG. 11 to fully close valve 72 and hold it closed.

The head member 443 of valve 122 has air bleed passages 484 and 486 which are respectively connected to the conduits 257 and 258 shown in FIG. 26 that are in turn connected to T-fitting 259 carried by conduit 260 that communicates with the recovery tank 261 whereby air discharged from the valve 122 is recycled through the engine fluid system.

FIG. 9 diagrammatically illustrates a control system suitable for the practice of the invention, for running the engine from a 12 volt direct current electrical energy source (such as an automobile battery 299), whereby when main off-on switch 321 is in the off position, the engine is shut down, and the air jack 27 is disposed in the position shown in FIG. 11 for biasing the air limiter valve 72 to closed position.

When the control switch 312 is switched to the "on" position, the start idle relay 145 is energized through photo cell 500 that is of a conventional type that increases in resistance, under current flow therethrough, to shut off current flow to relay 145 (in about 30 seconds) as energization of the coil of relay 145 is not needed after the relay has once been shifted (thrust rod 146 being held against shifting by being frictionally gripped between the arms 501 of clamp device 144 having adjustment screw 504 to adjust the clamping action involved).

When the accelerator pedal is released, spring 276 acts on wheel 123 to rotate same to turn switch 267 off and switch 268 on. Current flow to relay 142 reverses, shifting its thrust rod in the opposite direction to reposition valve 122 for actuating the air jack to bias the valve 72 toward closed position (but valve 72 is held in idle position by swing arm 269). Moving the switch 312 to its off position reverses the position of relay 145, which is now energized through photo cell 510, whereby valve 72 fully closes under the operation of air jack 127. Cell 510 is of the same type as cell 500, to discontinue current flow therethrough when relay 145 has repositioned its thrust rod 146 (that is frictionally held in its new position by clamp device 144). Clamp device 144 is, of course, adjusted to permit the required shifting of thrust rod 146, while holding it secure against change lacking energization of relay 145. The engine 214 is now shut down.

In the event that the pressure in the pressure tank goes below a predetermined minimum, switch 208 is actuated to condition the spare tank relay 294 to bring the spare tank in communication with the air pressure tank. This will be particularly useful where the engine has been shut down for extended periods of time to permit the starting of the engine on the pressure in the spare tank.

The pressure and vacuum tanks and the engine block 5 may be secured together by suitable framing, such as that suggested at 110 and 137 (see FIGS. 2 and 3).

It will therefore be seen that the invention provides a mechanism to provide kinetic energy in rotary form from unbalanced pressure involving a combination of compressed air under heated conditions and a source of vaccum under cooled conditions. The invention provides a prime mover requiring no combustible fuel and consequently operating without pollution or fuel requirements. The engine can be set at the desired horsepower for a particular application and its air pump automatically comes in to operate to increase the pressure differential between the pressure tank and source of vacuum above predetermined minimums. The engine itself can be employed to operate the air pump, but, of course, the air pump may be driven through other sources of energy. While periodic charges of compressed air will be required to make up for the energy expended by the engine, air storage facilities are safe and reliable.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

I claim:

1. An air driven engine apparatus comprising:

an engine block having a plurality of cylinders each having a piston reciprocably mounted therein and connected in cranking relation to a crank shaft journalled in the engine, a source of heated air under pressure, a source of vacuum under refrigerated conditions, a cylinder air flow input timer, air pressure conduit means connecting the source of air under pressure to said input timer including valve means for controlling the volume rate of air flow to said timer, and a cylinder air flow output timer, air vacuum conduit means connecting said output timer to the source of vacuum including a vacuum timer, said cylinders each having a separate conduit communicating between same and said timers, said timers being oriented to, for each cylinder, sequentially connecting such cylinder only to the source of air under pressure on the power stroke of the piston thereof, and sequentially connecting such cylinder only to the source of vacuum on the return stroke of the piston thereof.

2. The apparatus set forth in claim 1 wherein:

said vacuum timer is oriented to connect said output timer to said source of vacuum only when said output timer is operative to connect the respective cylinders to said vacuum timer.

3. The apparatus set forth in claim 1 wherein:

said source of heated air under pressure comprises an air pressure tank including means for heating same.

4. The apparatus set forth in claim 3 wherein:

said source of vacuum comprises a vacuum tank and means for refrigerating same.

5. The apparatus set forth in claim 1 including:

air pump means including means for supplying air under pressure to said source of air under pressure, by drawing same from air source means including said source of vacuum.

6. The apparatus set forth in claim 1 wherein:

said source of heated air comprises an air pressure tank including means for heating same, and including air pump means for supplying air under pressure to said pressure tank by drawing same from air source means including source of vacuum, and a spare air pressure tank connected to said heated pressure tank by conduit means including pressure sensitive valve means for connecting said spare tank with said heated tank when the pressure in said heated tank reaches a predetermined minimum.

7. The apparatus set forth in claim 6 wherein:

said heated tank and said spare tank are connected in parallel to said air pump.

8. The apparatus set forth in claim 1 including:

including means for reversably biasing said flow rate valve between closed and open positions, means for holding said flow rate valve at engine idle flow rate when said engine is to be at idle speed, off-on means for switching said flow rate valve between full flow shut off and said idle flow, and accelerator means actionable on said flow rate valve only when said off-on means has positioned said flow rate valve at said idle flow, said reversably biasing means including means for making same effective to bias said flow rate valve to open position when said acceleration means is actuated.

9. In a piston and cylinder type engine including an engine block having a plurality of cylinders each having a piston reciprocably mounted therein and connected in cranking relation to a crank shaft journalled in the engine, the method of driving same which comprises:

exposing in sequence the driving side of each piston on its power stroke to a source of heated air under pressure, exposing in sequence the driving side of each piston on its return stroke to a source of vacuum under cooled conditions, and varying rhe air volume flow rate through said cylinders to provide the speed of output of the engine.

10. The method set forth in claim 9 wherein:

the air driving the engine is recycled through the engine with make up air being added as needed to maintain a predetermined amount of air cycling through the motor.

11. The method set forth in claim 9 wherein:

the source of air under pressure and the source of vacuum are maintained under predetermined differences of pressure and temperature.

12. The apparatus set forth in claim 4 wherein:

the air of the pressure tank is at a pressure in the range of from about 190 psig to about 210 psig, and at a temperature in the range of 150° F. to about 250° F., and the air of the vacuum tank is at a pressure in the range of from about 6 psig to about 12 psig at a temperature in the range of from about 10° F. to about 20° F.

13. The method set forth in claim 9 wherein:

the air of the pressure source is at a pressure in the range of from about 190 psig to about 210 psig, and at a temperature in the range of 150° F, to about 250° F, and the air of the vacuum source is at a pressure in the range of from about 6 psig to about 12 psig at a temperature in the range of from about 10° F. to about 20° F.

* * * * *